US012472545B2

(12) United States Patent
Zielenbach et al.

(10) Patent No.: US 12,472,545 B2
(45) Date of Patent: Nov. 18, 2025

(54) DEVICE AND METHOD FOR ROLLING A METAL STRIP

(71) Applicant: SMS GROUP GMBH, Düsseldorf (DE)

(72) Inventors: Michael Zielenbach, Siegen (DE); Olaf Norman Jepsen, Siegen (DE)

(73) Assignee: SMS Group GmbH, Düsseldorf (DE)

( * ) Notice: Subject to any disclaimer, the term of this patent is extended or adjusted under 35 U.S.C. 154(b) by 226 days.

(21) Appl. No.: 18/246,086

(22) PCT Filed: Sep. 9, 2021

(86) PCT No.: PCT/EP2021/074807
§ 371 (c)(1),
(2) Date: Mar. 21, 2023

(87) PCT Pub. No.: WO2022/063594
PCT Pub. Date: Mar. 31, 2022

(65) Prior Publication Data

US 2023/0356278 A1 Nov. 9, 2023

(30) Foreign Application Priority Data

Sep. 22, 2020 (DE) ..... 10 2020 211 850.7
Sep. 3, 2021 (DE) ..... 10 2021 209 714.6

(51) Int. Cl.
*B21B 37/62* (2006.01)
*B21B 1/22* (2006.01)
(Continued)

(52) U.S. Cl.
CPC ..... *B21B 37/62* (2013.01); *B21B 1/22* (2013.01)

(58) Field of Classification Search
CPC ..... B21B 37/62; B21B 37/64; B21B 1/22; B21B 38/08; B21B 38/10; B21B 2271/06; B21B 2271/02; B21B 31/32
See application file for complete search history.

(56) References Cited

U.S. PATENT DOCUMENTS

2010/0005844 A1* 1/2010 Felkl ..... B21B 37/62 700/150
2020/0238353 A1* 7/2020 Dagner ..... B21B 37/40
2022/0126337 A1* 4/2022 Dagner ..... B21B 27/021

FOREIGN PATENT DOCUMENTS

CN 108114993 A1 6/2018
DE 1956746 A1 7/1970
(Continued)

OTHER PUBLICATIONS

Office Action issued on Apr. 17, 2024, in corresponding Japanese Application No. 2023518178, 10 pages.
(Continued)

*Primary Examiner* — Mohammed S. Alawadi
(74) *Attorney, Agent, or Firm* — Maier & Maier, PLLC

(57) ABSTRACT

A device and a method for rolling a metal strip. A distance of the upper/lower backup roll at at least one point thereof from a predetermined upper/lower reference point is measured by an upper/lower sensor and the measured values of the sensors are sent to a control device. A strain of the roll stand is calculated using a mathematical model, taking into account the rolling force generated. By the control device, an absolute value of the roll gap and thus the resulting thickness of the rolling stock is determined by the control device on the basis of the measured positions of the backup rolls and the calculated strain of the roll stand.

18 Claims, 4 Drawing Sheets

(51) Int. Cl.

| | |
|---|---|
| ***B21B 1/32*** | (2006.01) |
| ***B21B 37/64*** | (2006.01) |
| ***B21B 38/08*** | (2006.01) |
| ***B21B 38/10*** | (2006.01) |

(56) References Cited

FOREIGN PATENT DOCUMENTS

| | | | |
|---|---|---|---|
| DE | 19618712 | A1 | 11/1997 |
| GB | 1241712 | A | 8/1971 |
| JP | S6272417 | A | 4/1987 |
| JP | H0460405 | A | 2/1992 |
| JP | H08024928 | A | 1/1996 |
| JP | 20067235 | A | 1/2006 |
| JP | 2009505835 | A | 2/2009 |
| JP | 2009248106 | A | 10/2009 |
| WO | 2007022841 | A1 | 3/2007 |
| WO | 2011003930 | A1 | 1/2011 |
| WO | 2019187994 | A1 | 10/2019 |

OTHER PUBLICATIONS

Office Action issued on Jul. 24, 2024, in corresponding Japanese Application No. 2023-518178, 8 pages.
International Search Report and Written Opinion issued Dec. 7, 2021, in corresponding International Application No. PCT/EP2021/074807, 21 pages.

* cited by examiner

DEVICE AND METHOD FOR ROLLING A METAL STRIP

FIELD

The invention relates to a device for rolling a metal strip and a corresponding method.

BACKGROUND

When producing or rolling rolled stock in the form of metal strips, it is important, inter alia, with regard to product quality, that the roll gap between the work rolls of a roll stand used for this purpose can be set precisely. Such a setting of the roll gap in turn presupposes that there is precise knowledge of the resulting roll gap during rolling or during operation of the roll stand. For this purpose it is known according to the state of the art to determine the thickness of a metal strip between the work rolls of a roll stand according to the gauge meter principle. The thickness of the rolling stock corresponds to the distance between the barrels of the top and bottom rolls. Starting from a zero point, the change in position in the adjusting cylinders is used to calculate this distance. When rolling a metal strip, the work rolls are pushed apart by the rolling force because the whole stand acts like a spring. The distance between the work rolls during rolling is therefore the sum of the movement of the adjusting cylinder and the elastic strain of the stand. The strain of the stand is calculated from the force measured in the transverse heads.

In connection with the above-mentioned calculation of the strain of a roll stand, the characteristic curve of the stand forms an essential component with which the stand strain can be calculated as a function of the force in the force measuring devices ("load cells") used for this purpose. This means that the stand characteristic curve must be known for such a calculation of the strain. In preparation for such a calculation, the stand characteristic is first determined without rolling stock by moving the work rolls directly onto one another. Here, the function of the stand characteristic depends on the width of the strip and the diameters of the work rolls. This function can only be measured if there is no metal strip between the work rolls and the work rolls are therefore pressed directly onto or against each other.

To roll a metal strip with a width that is less than the width of the work roll, the characteristic curve must be converted to the current width based on mathematical models of the stand. In other words, the stand characteristic has to be converted in the event that a metal strip to be rolled is narrower than the roll width, which is, in fact, regularly the case. The mathematical models available for this are imprecise or not exact, so that no exact thickness results. Other disadvantages of the conventional determination of the actual value of the roll gap or its actual thickness, which occurs during rolling, are that the force measurement is also falsified by frictional forces, and that wear on the rolls of the roll stand must be recorded also mathematically. This can lead to further errors in the calculation of the actual thickness of the roll gap.

According to the state of the art, it is known from CN 108114993 and JPS 62072417 that when rolling a metal strips to determine the roll gap, the position of backup rolls must also be determined by measurement and taken into account accordingly.

SUMMARY

It is therefore the object of the invention to use simple means to optimize the determination of a roll gap, which occurs during operation of a roll stand when rolling a metal strip between the associated work rolls, with a view to greater accuracy and then set it to a desired target value.

A device according to the present invention is used for rolling a metal strip, in particular steel strip. Such a device comprises a roll stand formed of a pair of stands and a pair of work rolls and upper and lower backup rolls, wherein the work rolls and the backup rolls are supported on the roll stand by respective associated chocks. A roll gap can be formed between the work rolls, wherein the work rolls are able to be supported by at least one respectively assigned backup roll. Furthermore, the device includes a measuring device, by means of which the value of the roll gap between the work rolls can be determined. The chocks of at least one backup roll are movably guided in the roll stand and can be adjusted vertically by a hydraulic cylinder. The measuring device has at least one upper sensor with which a distance from at least one point on the upper backup roll to a predetermined upper reference point can be measured, and at least one lower sensor with which a distance can be measured from at least one point on the lower backup roll to a predetermined lower reference point. The measuring device comprises a force measuring device which is positioned between a chock of a backup roll, preferably the lower backup roll, and the roll stand, wherein a rolling force generated by the roll stand can be measured by means of the force measuring device. The device according to the invention also comprises a control device which is connected to the measuring device in terms of signals, wherein the control device is equipped with at least one mathematical model with which a strain of the roll stand can be calculated taking into account the rolling force generated. In this case, the control device is set up programmatically in such a way that an absolute value of the roll gap and thus the resulting thickness of the rolling stock can be determined on the basis of the measured values of the upper/lower sensor with regard to the measured position of the upper/lower backup roll and a strain of the roll stand calculated by the mathematical model, wherein this absolute value for the roll gap can be compared with a target value for the roll gap by means of the control device and on the basis of which the hydraulic cylinder can then be controlled for the vertical displacement of the associated backup roll, in order thereby to adjust the roll gap or the resulting thickness of the rolling stock in the form of the metal strips regulated to the desired target value.

In the same way, the invention provides a method for rolling a metal strip, in particular steel strip. In this method, a device according to the invention can be used as explained—in any case, in this method a roll gap is set between work rolls that are attached to a roll stand of a device for rolling a metal strip. The method according to the invention is characterized in that a distance of the upper/lower backup roll is measured at at least one point thereof from a predetermined upper/lower reference point by an upper/lower sensor and the measured values of the sensors are sent to a control device that a strain of the roll stand is calculated with a mathematical model with which the control device is equipped, taking into account the rolling force generated, and that by means of the control device on the basis of the positions of the backup rolls measured by the upper sensor and the lower sensor and a strain calculated by the mathematical model of the roll stand is determined an absolute value of the roll gap and thus the resulting thickness of the rolling stock. This absolute value for the roll gap is then compared with a target value for the roll gap by means of the control device and on the basis of this at least one backup roll is then adjusted, preferably hydraulically, in order to regulate the roll gap or the resulting thickness of the rolling stock in the form of the metal strip to the target value.

The present invention is based on the essential finding that a movement of the backup rolls or the associated backup roll barrel is directly measured by suitable sensors, namely the upper and/or lower sensor, so that this movement of the backup rolls must no longer be calculated using a mathematical model. In other words, by measuring the backup roll movement, a large part of the actual strain of the roll stand is determined by measurement and then no longer has to be calculated on the basis of a (inexact) mathematical model from the force measurement that is subject to friction. This also results in the advantage that an error-prone calculation of the influence of the strip width on the strain of the rolls, as is provided according to the prior art mentioned at the outset, is not necessary.

A further advantage of the invention in connection with the direct measurement of the movement of the backup roll barrel is that the eccentricity of the backup roll(s) can be measured directly with this measurement. This makes it possible to almost completely compensate for the eccentricity of the backup roll(s) that can occur during rolling operation.

According to the invention, the direct measurement of the movement of a backup roll is carried out at at least one or more points thereof across the width of the corresponding backup roll, namely with regard to a distance from a predetermined upper or lower reference point. Based on this, an exact or absolute spatial position of a backup roll is possible, also taking into account a possible deformation of the backup roll during rolling operation, and in this respect—also taking into account the calculated strain of the roll stand—a determination of an absolute value of the roll gap or the thickness of a rolling stock in the form of a metal strip between the work rolls is then ensured.

At this point, it is specifically pointed out that the feature "strain of the roll stand" in the sense of the present invention is formed at least by the following components:

- Elongation of the stand or the pair of stands, which (s) are or is assigned to the roll stand,
- Flattening of the work rolls against the rolling stock or the metal strip, and/or
- Flattening that occurs between the work rolls and the backup rolls.

As explained above, such a strain of the roll stand can be suitably calculated by using a mathematical model equipped in the control device.

In an advantageous development of the invention, it can be provided that the control device is programmed with respect to the mathematical model in such a way that the parts of the strain of the roll stand that have been determined directly by measuring the positions of the backup rolls are removed from the stand spring.

Attachment of the sensors (i.e., upper sensor and/or lower sensor) can be made to the crossbars of the roll stand which are attached between the pair of stands. In concrete terms, this means that the upper sensor can be attached to the upper crossbar, wherein the lower sensor is able to be attached to the lower crossbar.

With regard to the lower sensor, it is pointed out separately at this point that this can alternatively be attached to the foundation of the roll stand. This ensures a further improved measurement accuracy for the lower sensor, because a deformation of the foundation is not likely even during operation of the device and the lower sensor can thus be attached or positioned in a location that cannot be changed.

In an advantageous development of the invention, the sensors (i.e., the upper sensor and/or the lower sensor) can each be designed as an optical sensor. In this case, the upper sensor and/or the lower sensor can be designed in the form of a laser triangulation sensor or in the form of a confocal sensor.

In an advantageous development of the invention, electromagnetic fields can be used for the sensors (i.e., the upper sensor and/or the lower sensor). In this case, it is expedient for the upper sensor and/or the lower sensor to be in the form of an eddy current sensor.

With regard to the possible embodiments of the sensors mentioned above, a "mixed form" is also possible. This means that, for example, the upper sensor is designed as an optical sensor, wherein electromagnetic fields are used for the lower sensor and the lower sensor can therefore be designed as an eddy current sensor. This also applies to the reverse case, i.e., the design of the upper sensor as an eddy current sensor and design of the lower sensor as an optical sensor.

According to an advantageous development of the invention, adjacent to the upper or lower sensor, a blowing device is arranged, with which compressed air can be introduced into a space located between a backup roll and a sensor. In this way, for example, water mist, dirt particles or comparable disturbing particles can be blown away or removed from the space between a backup roll and a sensor, as a result of which the measuring accuracy for the respective sensor in relation to the measured position of an assigned backup roll is improved.

When correcting thickness disturbances, particularly on thin materials or metal strips, a movement of the "HGC" (cf. FIG. 3, FIG. 4) or the backup rolls of a roll stand results for the most part from the compensation of the changing stand strain. Put simply, the strain is determined by the following equation:

$$\text{strain} = \frac{\text{measured rolling force}}{\text{stand spring}}$$

Expressed in words, the strain is determined—in simple terms—from the quotient of the measured rolling force and the stand spring. Based on the fact that part of the strain of the roll stand, in particular a deformation or movement of the backup rolls, is now determined directly by the sensors mentioned, these measured parts of the strain can be removed from the stand spring, which becomes larger as a result. As a result of the stand spring being larger, the calculated strain becomes smaller. This also reduces the influence of friction in the measured (rolling) force. Percentage errors in the stand spring also result in lower strain errors.

In an advantageous development of the invention, the control device can be equipped with a mathematical compensation model, with which thermals and wear of the work rolls and/or the backup rolls can be calculated. In this way, it is possible to directly calculate the change in a diameter of the work rolls and/or backup rolls during the rolling process as a result of wear and temperature. This can be taken into account for the hydraulic adjustment of at least one backup roll, in order to set the roll gap or the resulting thickness of the rolling stock in the form of the metal strip to the target value in a controlled manner. This makes it possible, during operation of the device according to the invention or when carrying out the method according to the invention, on the one hand to improve the accuracy for the set roll gap and on the other hand to gain knowledge of the current state of wear of the work rolls and/or the backup rolls, in order to then only replace the respective rolls when actually required (and not time-dependent, i.e., after predetermined fixed times).

BRIEF DESCRIPTION OF THE FIGURES

Further advantages and details of the invention follow from the exemplary embodiments described below and from the drawings. Showing.

DETAILED DESCRIPTION

Figure 1:
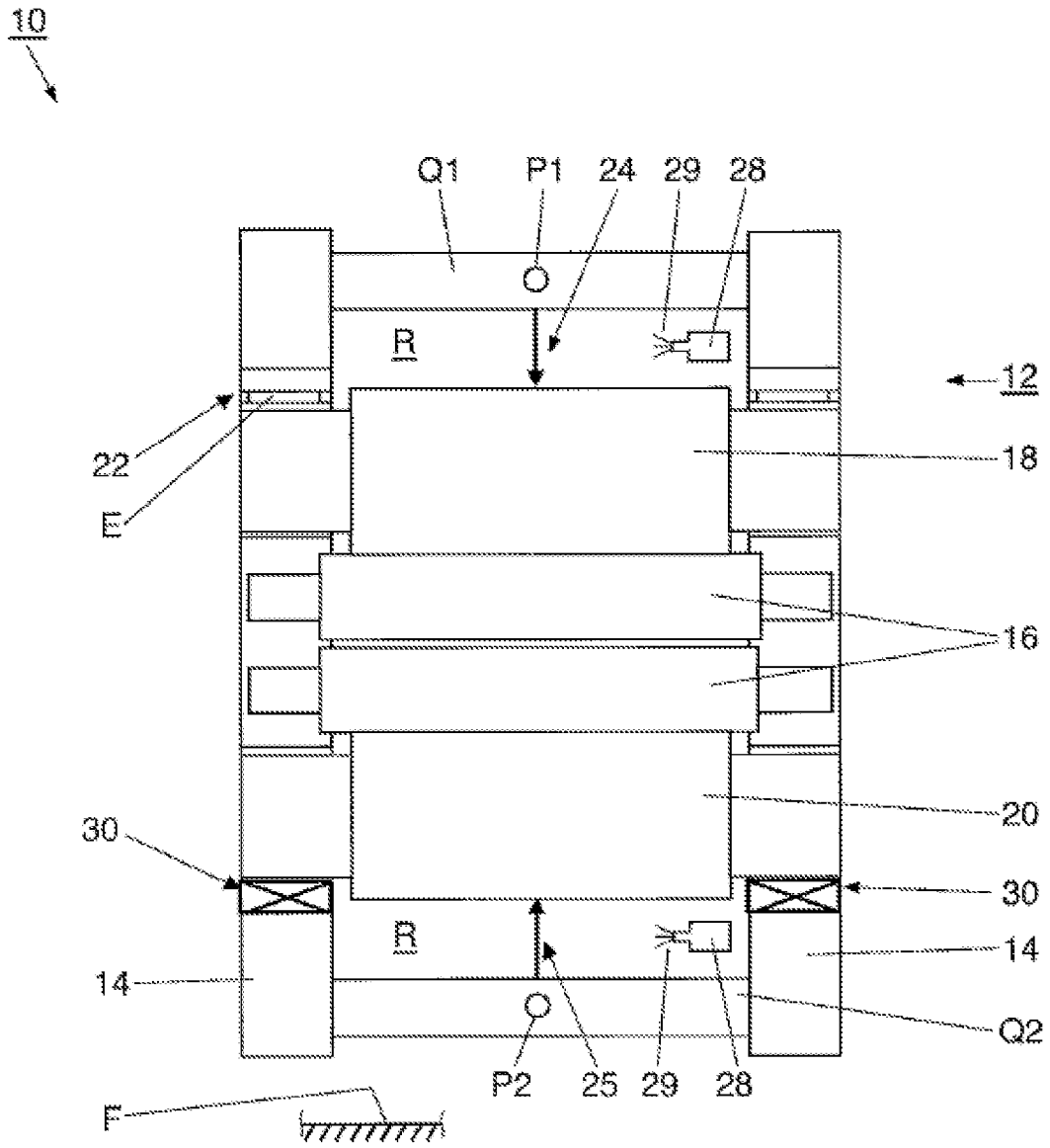
FIG. 1 a simplified view of a device according to the invention for rolling a metal strip, FIG. 2 a simplified view of a device for rolling a metal strip according to another embodiment of the invention, FIG. 3 a simplified view of the device according to the invention from FIG. 1 or FIG. 2, supplemented by the symbols of a control loop of an associated control device, and FIG. 4 a simplified view of the device of FIG. 1 or FIG. 2 respectively, according to a further embodiment of the invention, supplemented by the symbols of a control loop of an associated control device.

Referring now to FIGS. 1-4, preferred embodiments of a device 10 and associated method for rolling a metal strip according to the present invention are shown and explained. The same features in the drawings are each provided with the same reference symbols. At this point it is pointed out separately that the drawings are merely simplified and in particular is not shown to scale.

FIG. 1 shows a simplified view of parts of the device 10 according to the invention according to a first embodiment. The device includes a roll stand 12 having a pair of stands 14 between which a pair of work rolls 16 are rotatably mounted. Furthermore, an upper backup roll 18 and a lower backup roll 20 are rotatably mounted between the stands 14 and arranged adjacent to a work roll 16, respectively.

In the exemplary embodiment of FIG. 1, the device 10 comprises a total of four rolls, namely, as explained, two work rolls 16 and two backup rolls 18, 20. The associated roll stand 12 of this device 10 is therefore a so-called four-high stand.

The work rolls 16 and the backup rolls 18, 19 are held on the roll stand 12 or the associated stands 14 by respectively assigned chocks E. In FIG. 1 only one of these chocks E is shown tightened for the purpose of a simplified representation.

The chocks E of at least one backup roll 18, 20 are movably guided in the roll stand in the vertical direction and are associated with a hydraulic cylinder 22. This is illustrated by way of example for the upper backup roll 18 in FIG. 1. By means of an actuation of the hydraulic cylinder 22, it is possible to adjust the upper backup roll 18 in the vertical direction and thereby change a distance between the two work rolls 16.

Between the uprights 14 of the roll stand 12, an upper crossbar Q1 and a lower crossbar Q2 are attached.

The device 10 according to the invention comprises a measuring device, by means of which a distance between the two work rolls 16 and thus a resulting roll gap W (cf. FIG. 3, FIG. 4) between the work rolls can be determined.

In the embodiment of FIG. 1, the above-mentioned measuring device comprises at least one upper sensor 24, which is attached to the upper crossbar Q1, and at least one lower sensor 25, which is attached to the lower crossbar Q2. In the representation of FIG. 1, these sensors 24, 25 are simply symbolized in each case by an arrow.

With the upper sensor 24, a distance of the upper backup roll 18 can be measured at least at one point thereof from a predetermined upper reference point P1. In the same way, the lower sensor 25 can be used to measure a distance from the lower backup roll 20 at at least one point here to a predetermined lower reference point P2.

In the context of the present invention, the aforementioned reference points P1 and P2 form fixed points, with respect to which the movement of the backup rolls 18, 20 is measured by means of the sensors 24, 25. For example, these reference points P1, P2 can be fixed on the upper crossbar Q1 or on the lower crossbar Q2, as is symbolized by corresponding circles in the embodiment of FIG. 1.

According to an alternative embodiment, it can be provided for the lower sensor 25 that it is attached to a foundation F (cf. FIG. 1) of the roll stand 12—instead of to the lower crossbar Q2. In this case, the predetermined lower reference point P2 is then expediently also fixed to the foundation F.

In the embodiment of FIG. 1, the sensors 24, 25 are each mounted in a central region of the crossbars Q1, Q2. Correspondingly, a distance of the backup rolls 18, 20 in a central region thereof from the predetermined reference points P1, P2 is measured by means of the sensors 24, 25. This means that the upper sensor 24 and the lower sensor 25 are positioned in relation to a width of the roll stand 12 such that these sensors 24, 25 each measure a distance from a point in the middle of the associated backup rolls 18, 20.

The measuring device also includes a force measuring device 30 which is positioned between a chock of a backup roll and the roll stand 12. In the representation of FIG. 1 it is shown, for example, an arrangement for such a force measuring device 30 which is arranged here adjacent to the respective chocks E of the lower backup roll 20. By means of the force measuring device 30 it is possible to measure the rolling force generated in the roll stand 12.

The device 10 according to the invention also comprises blowing devices 28 (cf. FIG. 1) which are arranged adjacent to the upper and lower sensors 24, 25, respectively. By means of these blowing devices 28, it is possible to introduce compressed air 29 into a space R located between a backup roll 18, 20 and the respective sensor 24, 25. For example, such a blowing device 28 can be designed in the form of a blower or ventilator. In any case, such a blowing device 28 and the compressed air 29 generated with it ensure that interfering particles in the space R between the backup rolls 18, 20 and the sensors 24, 25, which particles can be formed from water mist, dirt particles or the like, are effectively removed. This makes a significant contribution to improving the measurement accuracy of the sensors 24, 25 in relation to a movement of the backup rolls 18, 20.

Figure 2:
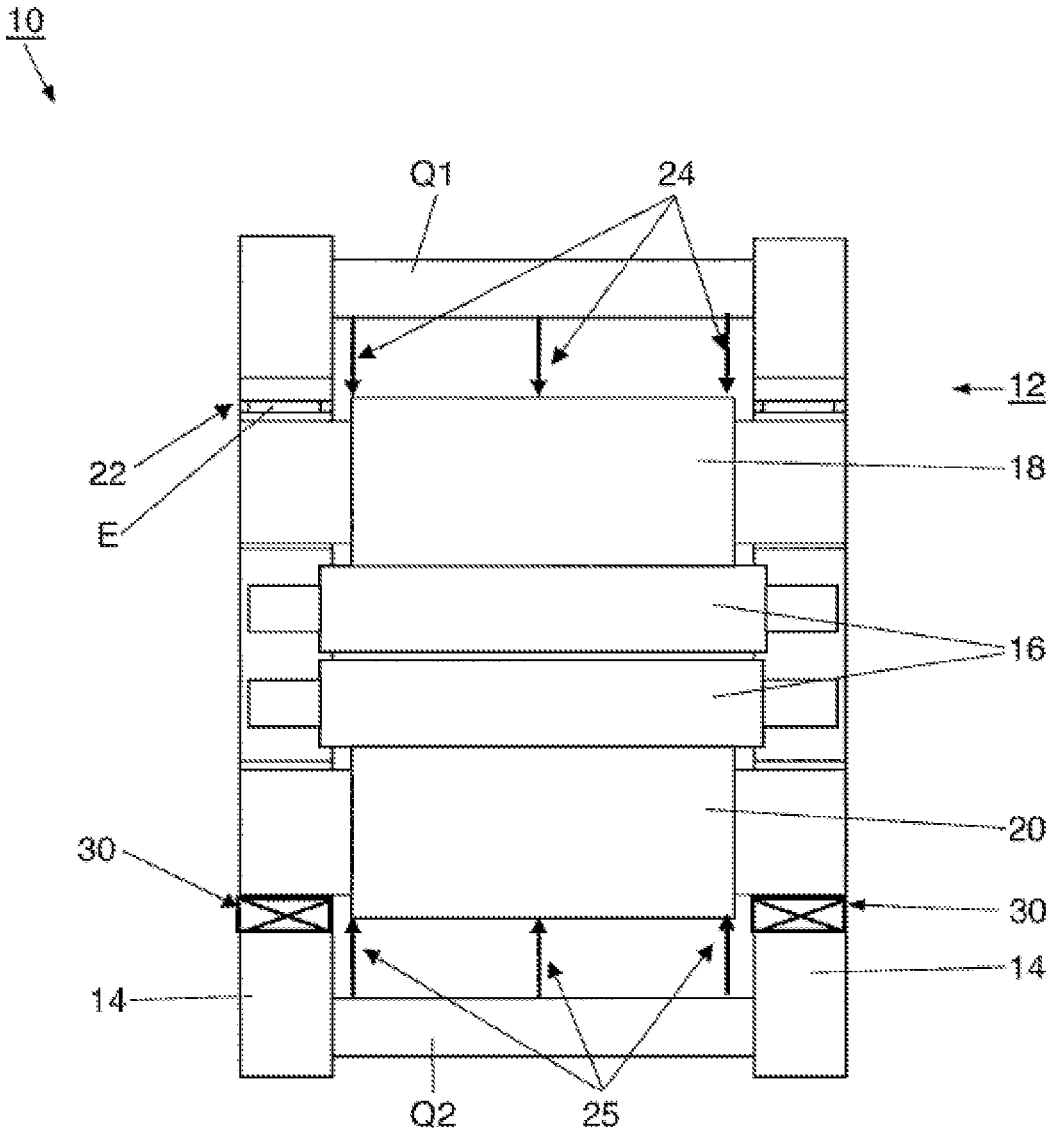

FIG. 2 shows parts of a second embodiment of the device 10 according to the invention. In contrast to the first embodiment of FIG. 1, a plurality of upper sensors 24 and lower sensors 25 are arranged adjacent to the upper backup roll 18 and the lower backup roll 20 which, in the same way as in FIG. 1, are symbolized here in simplified form only by arrows. For example, three sensors 24, 25 are provided here along a width extension of the respective backup rolls 18, 20. In this regard, it goes without saying that the plurality for the upper sensors 24 or lower sensors 25 can also be different from three, that is to say can also be, for example, more or less than three. Otherwise, the embodiment of FIG. 2 corresponds to that of FIG. 1, so that to avoid repetition, reference may be made to the explanations for FIG. 1.

Figure 3:
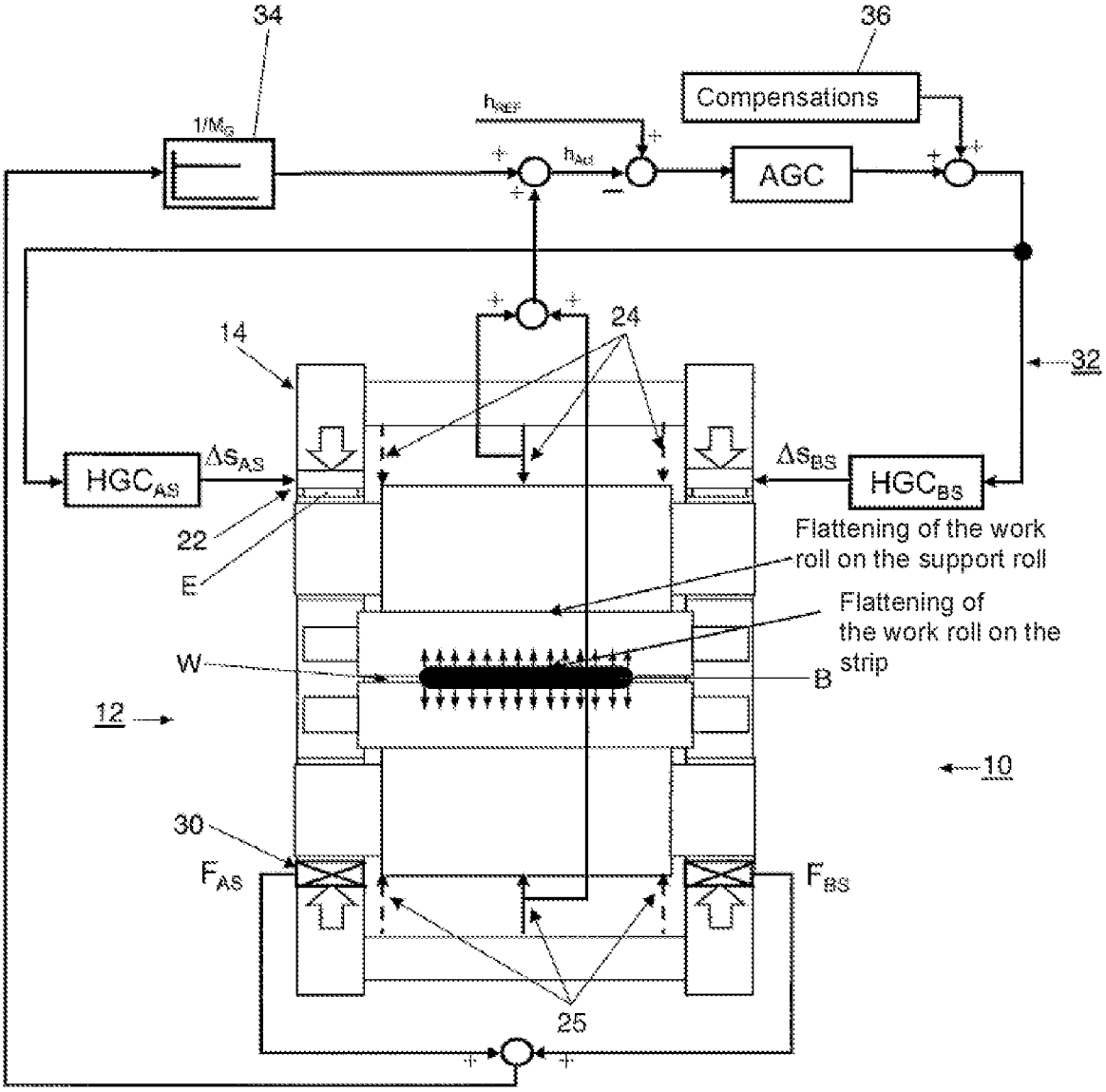

In the following, further features for the device 10 according to the invention and its mode of operation as well as for a method according to the present invention are shown and explained in FIGS. 3 and 4:

The embodiment of FIG. 3 corresponds to the embodiment of FIG. 1 or FIG. 2, with details of a control device 32 and the associated control loop also being shown, which are also part of the device 10 according to the invention.

It should first be pointed out for FIG. 3 that an upper sensor 24 and a lower sensor 25 are arranged in a central region of the associated backup roll 18, 19. This corresponds to the illustration in FIG. 1. Optionally, a plurality of first sensors 24 and second sensors 25 can be arranged along a width of the associated backup roll 18, 20, wherein these additional sensors are symbolized here by dashed arrows. Such a plurality of sensors 24, 25 then corresponds to the illustration in FIG. 2.

FIG. 3 makes it clear that the upper and lower sensors 24, 25 and also the force measuring device 30 are each connected to the control device 32 in terms of signals. In this way, the control device 32 receives information regarding the movements or deformations of the backup rolls 18, 20 that can occur during rolling operation.

The control device 32 is equipped with a mathematical model 34 with which a strain of the roll stand 12 can be calculated, taking into account the rolling force generated. According to the invention, it is important that the measured values for the rolling force measured on the drive side of the roll stand ("$F_{AS}$") and for the rolling force measured on the operator side of the roll stand ("$F_{BS}$") are each sent to this mathematical model 34. In this regard, it is pointed out that the rolling forces generated in FIG. 3 are symbolized by corresponding block arrows positioned in the stands 14.

As already explained elsewhere above, the strain of the roll stand 12 can be calculated by the mathematical model 34 according to the invention. In this regard, FIG. 3 illustrates that flattening occurs during rolling operation both between the metal strip B and the work rolls 16 on the one hand and between the work rolls 16 and the backup rolls 18 adjoining them on the other. These flattenings form part of the strain of the roll stand 12, which is calculated using the mathematical model 34.

Figure 4:
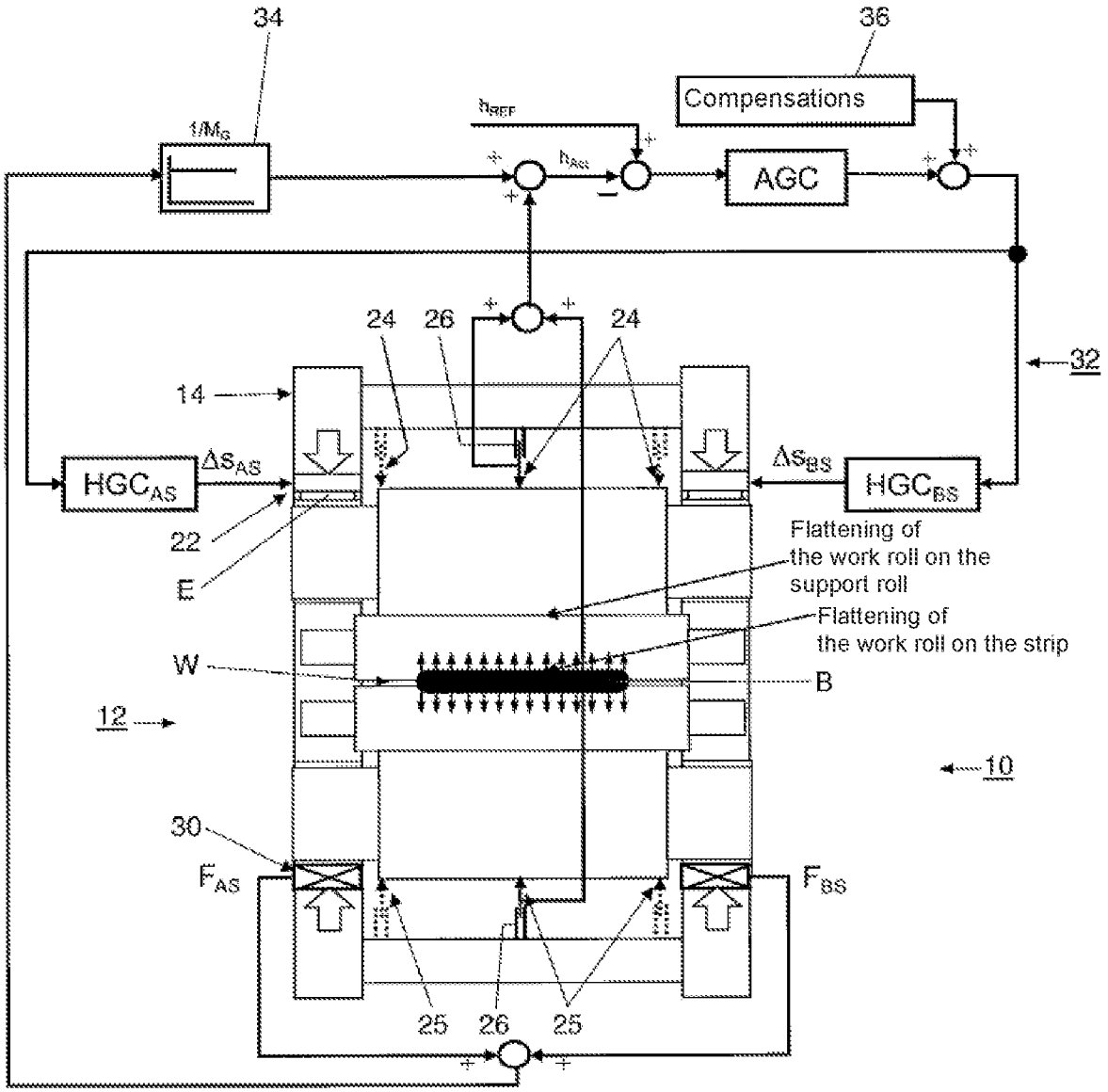

FIG. 4 illustrates a third embodiment of the device 10 according to the invention. In contrast to the embodiment of FIG. 3, here the sensors 24, 25 are each equipped with adjusting devices 26 with which the position of a respective sensor 24, 25 can be adapted to a different diameter of an associated backup roll 18, 20. This means that, depending on a roll diameter of the respective backup rolls 18, 20, the sensors 24, 25 can be moved vertically in or out of the roll stand 12. In other words, a position of the upper or lower sensor 24, 25 relative to the upper or lower backup roll 18, 20 can be changed by means of the adjusting devices 26, as explained in adaptation to the respective diameter of the backup rolls 18, 20. Regarding their other features the embodiment of FIG. 4 corresponds to that of FIG. 3, so that, in order to avoid repetition, reference may be made to the explanations for FIG. 3.

The other symbols used in FIG. 3 and FIG. 4 are understood as follows:

AGC: "Automatic Gauge Control": This means an automatic adjustment of the roll gap by means of a corresponding vertical adjustment of at least one backup roll.

HGCAs: "Hydraulic Gauge Control" on the drive side AS: This means an actuation of the hydraulic cylinder 22, which is assigned to a chock E of the upper backup roll 18 on the drive side AS.

SAS: This means the distance by which the chock E of the upper backup roll 18 is vertically displaced on the drive side AS when the hydraulic cylinder 22 arranged there is employed.

HGCBs: "Hydraulic Gauge Control" on the operator side BS: This means an actuation of the hydraulic cylinder 22, which is assigned to a chock E of the upper backup roll 18 on the operator side BS.

SBS: This means the distance by which the chock E of the upper backup roll 18 is vertically displaced on the operator side BS when the hydraulic cylinder 22 arranged there is employed.

The invention now works as follows:

To roll a metal strip, this is passed between the work rolls 16 of the roll stand 12. In this case, the work rolls 16 are spaced apart from one another, so that a roll gap is formed between the work rolls 16. In FIGS. 3 and 4, the metal strip is denoted by "B" and the roll gap that occurs between the work rolls 16 including the metal strip B is symbolized by the arrow "W".

During rolling operation, a distance from the upper backup roll 18 at at least one point thereof (see FIG. 1) or at, for example, three points along the width extension of the backup roll 18 (see FIG. 2) to the predetermined upper reference point P1 is measured by the upper sensor(s) 24, wherein the resulting measured values are then sent to the control device 32. In the same way, a distance of the lower backup roll 20 at at least one point thereof (see FIG. 1) or at, for example, three points along the width extension of the backup roll 20 (see FIG. 2) to the predetermined lower reference point P2 is measured by the or the lower sensor(s) 25. Then the measurement signals from the sensors 24, 25 are sent to the control device 32.

Taking into account the rolling forces $F_{AS}$, $F_{BS}$ measured by the force measuring devices 30, a strain of the roll stand is calculated by the mathematical model 34, as explained.

According to the method according to the invention, it is then provided that by means of the control device 32 on the basis of the positions of the backup rolls 18, 20 measured by the upper sensor 24 and the lower sensor 25 and a strain of the roll stand 12 calculated by the mathematical model 34 an absolute value of the roll gap W and thus the resulting thickness of the rolling stock is determined, wherein this absolute value ("$h_{Act}$") for the roll gap W is compared with a target value ("$h_{REF}$") for the roll gap W by means of the control device 32 and at least based on this the backup roll 18 is then adjusted hydraulically by the hydraulic cylinder 22 in the vertical direction in order to set the roll gap W or the resulting thickness of the rolling stock in the form of the metal strip B to the target value in a controlled manner.

In order to carry out the above-mentioned method according to the invention, the control device 32 is set up accordingly in terms of programming. For the present invention, this means that by means of the control device 32 based on the measured values of the upper and lower sensors 24, 25 with regard to the measured position of the upper/lower backup roll 18, 20 and a strain of the roll stand 12 calculated by the mathematical model 34, an absolute value of the roll gap W and thus the resulting thickness of the rolling stock can be determined. Subsequently, this absolute value $h_{Act}$ is compared with the target value $h_{REF}$ for the roll gap W by means of the control device 32 and on the basis of this the hydraulic cylinder 22 is then controlled for the vertical displacement of the associated upper backup roll 18 in order to thereby adjust the roll gap W or the resulting thickness of the rolling stock in the form of the metal strip B to the desired target value.

To further improve the measurement accuracy, the invention can provide for the control device 32 to be equipped with a mathematical compensation model, which is denoted by "36" in FIGS. 3 and 4 and provided with the designation "compensation". Using such a mathematical compensation model 36, thermals and wear of the work rolls 16 and/or the backup rolls 18, 20 can be calculated, wherein on the basis of this corresponding correction variable can be introduced into the controlled system.

The present invention has been explained above with reference to possible embodiments of the device 10, which correspond to a so-called "four-high stand". As an alternative to this, the device 10 according to the invention can also be designed in the form of a so-called "six-high stand", wherein the roll stand 12 is equipped with a total of four backup rolls. In this case, the explanations given above for the backup rolls 18, 20 refer, mutatis mutandis, to the respective outer backup rolls of a six-high stand, in order to adjust the roll gap W or the resulting thickness of the rolling stock in the form of the metal strip B to a desired target value in a controlled manner as a result and in the same way.

LIST OF REFERENCE NUMBERS

10 Device
12 Roll stand
14 Stand
16 Work roll(s)
18 Upper backup roll
20 Lower backup roll
22 Hydraulic cylinder
24 Upper sensor
25 Lower sensor
26 Adjusting device (for upper sensor 24/lower sensor 25)
28 Blowing device
29 Compressed air
30 Force measuring device
32 Control device
34 Mathematical model
36 Mathematical compensation model
B Metallic strip
E Chock(s)
F Foundation
$h_{REF}$ Target value (for the roll gap W)
Q1 Upper crossbar
Q2 Lower crossbar
P1 Predetermined upper reference point
P2 Predetermined lower reference point
R Space (between a backup roll 18, 20 and a sensor 24, 25)
W Roll gap

The invention claimed is:

1. A device for rolling a metal strip, comprising a roll stand formed by a pair of stands, a pair of work rolls and backup rolls, the backup rolls having an upper backup and lower backup roll, wherein the work rolls and the backup rolls are each supported by respective associated chocks on the roll stand, wherein a roll gap is formed between the work rolls, and the work rolls are each supported by at least one backup roll, and a measuring device is configured to determine a value of the roll gap between the work rolls, wherein each of the respective associated chocks are movably guided by at least one of the upper backup roll and the lower backup roll in the roll stand, and is adjusted vertically by a hydraulic cylinder, wherein the measuring device comprises at least one upper sensor configured to measure a distance from at least one point on the upper backup roll to a predetermined upper reference point, and at least one lower sensor configured to measure a distance from at least one point on the lower backup roll to a predetermined lower reference point, the measuring device comprises a force measuring device positioned between at least one of the respective associated chock of the lower backup roll and the roll stand, wherein the force measuring device is configured to measure a rolling force generated with the roll stand, the measuring device is configured to send signals to a control device, wherein the control device is equipped with at least one mathematical model to calculate a strain of the roll stand, taking into account the rolling force generated, and the control device is configured to determine an absolute value of the roll gap and thus a resulting thickness of a rolling stock on a basis of the measured distance from at least one point on the upper backup roll, distance from at least one point on the lower backup roll and the strain of the roll stand calculated by the mathematical model wherein the absolute value for the roll gap is compared with a target value for the roll gap by the control device, and the hydraulic cylinder is controlled for a vertical displacement of either the upper backup roll or the lower backup roll or both, in order to set the roll gap or the resulting thickness of the rolling stock in a form of the metal strip to a desired target value in a controlled manner.

2. The device according to claim 1, wherein the control device is equipped with a mathematical compensation model with which thermals and wear of the work rolls and/or the backup rolls is calculated.

3. The device according to claim 1, wherein the roll stand has an upper crossbar on which the at least one upper sensor is attached.

4. The device according to claim 1, wherein the roll stand has a lower crossbar on which the at least one lower sensor is attached.

5. The device according to claim 1, wherein the at least one lower sensor is attached to a foundation of the roll stand.

6. The device according to claim 1, wherein the at least one upper sensor and/or the at least one lower sensor are connected to a respective associated adjusting device, wherein a position of the at least one upper or the at least one lower sensor relative to the upper backup roll or the lower backup roll is variable by the respective associated adjusting device.

7. The device according to claim 1, wherein the at least one upper sensor and/or the at least one lower sensor are positioned in relation to a width of the roll stand such that a distance to a point in a center of the backup rolls is measured.

8. The device according to claim 1, wherein the at least on upper sensor and/or the at least one lower sensor are each—an optical sensor, a laser triangulation sensor, or a confocal sensor.

9. The device according to claim 8, wherein a blowing device is provided adjacent to the at least one upper sensor and another blowing device is provided adjacent to the at least one lower sensor, and compressed air is introduced into a space between respective backup roll and sensor using the blowing devices.

10. The device according to claim 1, wherein the at least one upper sensor and/or the at least one lower sensor are eddy current sensors.

11. The device according to claim 1, wherein the at least one upper sensor or the at least one lower sensor comprises a plurality of upper sensors or lower sensors is provided respectively adjacent to the upper or lower backup roll along a width of an associated backup roll.

12. A method for rolling, comprising:

setting roll gap between a pair of work rolls and backup rolls supported by the respective associated chocks on roll stand, measuring a distance of a upper backup roll at least one point thereof from a predetermined upper reference point by an upper sensor, a distance of a lower backup roll at least one point thereof from a predetermined lower reference point by an lower sensor, and the measured distances of the sensors are sent to a control device, calculating a strain of the roll stand with a mathematical model with which the control device is equipped, taking into account the generated rolling force, and determining a resulting thickness of the rolling stock, by the control device, on a basis of the measured distance of the upper backup roll, the measured distance of the lower backup roll, and a strain of the roll stand calculated by the mathematical model an absolute value of the roll gap, comparing the absolute value for the roll gap with a target value for the roll gap, hydraulically adjusting at least one backup roll to adjust the roll gap or the resulting thickness of the rolling stock in the form of the metal strip to the target value in a controlled manner.

13. The method according to claim 12, programming the control device with respect to the mathematical model in such a way that parts of the strain of the roll stand which have been determined directly by measuring the positions of the backup rolls, are removed from a stand spring.

14. The method according to claim 12, wherein the control device is equipped with a mathematical compensation model with which thermals and wear of the work rolls and/or the backup rolls are calculated, wherein the hydraulic adjustment of the at least one backup roll are taken into account in order to set the roll gap or the resulting thickness of the rolling stock in the form of the metal strip to the target value in a controlled manner.

15. The method according to claim 12, the upper sensor and/the lower sensor are arranged along a width of the respective backup roll.

16. The method according to claim 12, wherein the upper sensor and/or the lower sensor are each designed as optical sensors.

17. The method according to claim 16, wherein a blowing device is provided adjacent to the upper sensor and another blowing device is provided adjacent to the lower sensor, and compressed air is introduced into a space located between respective backup roll and sensor.

18. The method according to claim 12, wherein the upper sensor and/or the lower sensor are eddy current sensors.

* * * * *